US005490740A

United States Patent [19]

Johnson

[11] Patent Number: 5,490,740

[45] Date of Patent: Feb. 13, 1996

[54] GROUND STABILIZED TRANSPORTABLE DROP HAMMER

[76] Inventor: Robert J. Johnson, 70 N. Monroe Ave., Columbus, Ohio 43203

[21] Appl. No.: 310,654

[22] Filed: Sep. 22, 1994

[51] Int. Cl.[6] ..... B25D 17/28; E01C 23/12

[52] U.S. Cl. ..... 299/37.4; 173/200; 404/133.05

[58] Field of Search ..... 404/90, 133.05, 404/133.1; 173/53–56, 200; 299/37, 69, 70

[56] References Cited

U.S. PATENT DOCUMENTS

| | | | |
|---|---|---|---|
| 2,659,583 | 11/1953 | Dorkins | 262/13 |
| 3,133,730 | 5/1964 | Cornett | 404/90 X |
| 3,509,723 | 5/1970 | Dorn | 60/57 |
| 3,658,139 | 4/1972 | Von Ruden | 173/124 |
| 3,819,144 | 6/1974 | Hatleuolt et al. | 299/37 |
| 4,243,107 | 1/1981 | Shook | 173/43 |
| 4,439,056 | 3/1984 | Reilly et al. | 404/90 |
| 4,634,311 | 1/1987 | Jinnings et al. | 404/90 |
| 4,852,661 | 8/1989 | Ellington | 173/84 |
| 5,012,873 | 5/1991 | Kennedy et al. | 173/53 X |
| 5,182,057 | 1/1993 | Johnson | 264/31 |
| 5,234,282 | 8/1993 | Osborn | 299/37 X |
| 5,299,857 | 4/1994 | Zanetis | 404/90 X |

*Primary Examiner*—Ramon S. Britts
*Assistant Examiner*—James A. Lisehora
*Attorney, Agent, or Firm*—Mueller and Smith

[57] ABSTRACT

A transportable drop hammer for impacting a ground surface adapted to be removably coupled to a driven host transport apparatus having lifting arms. An upstanding frame is couplable to the host transport apparatus and is provided as having a stabilizing foot portion attached to the frame for contacting the ground surface. A mast is mast attached to the frame and is disposed substantially vertical to the ground surface. A weight assembly, having a ground confronting face portion and at least one bearing surface engaging the mast, is operable between a ground position impacting the ground surface and a drop position. For selectively raising the weight assembly to a predetermined drop position, a manually controlled lifting apparatus is provided which actuable to release the weight assembly for its substantial free fall from the drop position to the ground position.

23 Claims, 4 Drawing Sheets

GROUND STABILIZED TRANSPORTABLE DROP HAMMER

BACKGROUND OF THE INVENTION

The present invention relates to construction equipment and more particularly to an easily transportable machine for breaking up paving material by a single operator.

The use of concrete breakers and the like with a variety of construction equipment, including skid steers and excavating equipment, is well known in the art. However, concrete breakers attached to hydraulically powered vehicles heretofore have typically comprised one of two types; a hydraulically driven vibrating bit, commonly referred to as a jack hammer, such as disclosed in U.S. Pat. No. 4,243,107, issued to Shook, and a gravity powered drop hammer utilizing a pivoting swing arm mounted on the lift arms of the equipment, as disclosed in U.S. Pat. No. 5,234,282, issued to Osborn.

Likewise, transportable, gravity powered drop hammers for breaking concrete and asphalt pavement are also known. Such apparatus are shown in U.S. Pat. Nos. 2,659,583, issued to Dorkins, and 4,852,661 issued to Ellington. Such portable devices are typically towed to a location and then operated manually by repeated raising and dropping a weight upon the ground work surface. When the desired amount of concrete breaking has occurred, the drop hammer carrier is moved or otherwise towed to the next work location.

Those concerned with these and other problems recognize the need for an improved transportable drop hammer. Accordingly, it is desirable to provide a concrete breaker which highly maneuverable, faster, easily adaptable to existing construction equipment and which can be operated in an efficient manner by a single operator.

SUMMARY OF THE INVENTION

Accordingly, it is an object of the present invention is to provide a transportable drop hammer for impacting a ground surface and adapted to be removably coupled to a driven host transport apparatus having lifting arms.

The drop hammer includes an upstanding frame couplable to the host transport apparatus and has a stabilizing foot portion for contacting the ground during operation of the drop hammer. A mast, attached to the frame and disposed substantially vertical to the ground surface, supports a weight assembly having a ground confronting face portion and at least one bearing surface which engages the mast. The weight assembly can be articulated by a single operator between a ground position impacting the ground surface and a predetermined drop position above the ground surface by a controlled lifting apparatus which raises the weight assembly to the predetermined drop position. The lifting apparatus is actuable to release the weight assembly for its substantial free fall from the drop position to the ground position impacting the ground surface.

Another object of the invention is to provide a system for impacting a ground surface. An operator driven host transport apparatus is provided as having lifting arms with a drop hammer assembly removably coupled thereto. The drop hammer assembly is formed as having an upstanding frame which is coupled to the host transport apparatus and has a stabilizing foot portion for contacting the ground during the operation of the drop hammer. A mast is attached to the frame and is disposed substantially vertical to the ground surface supports. The mast supports a weight assembly having a ground confronting face portion and at least one bearing surface engaging the mast. The weight assembly is operable between a ground position impacting the ground surface and a predetermined drop position above the ground surface by a lifting assembly which raises the weight assembly to a predetermined drop position. The lifting assembly is actuable to release the weight assembly for its substantially free fall from the drop position to the ground position impacting the ground surface.

Yet another object of the invention is to provide a method for impacting a ground surface to the ground position impacting the ground surface. An operator actuated drop hammer assembly is provided to be removably coupled to an operator driven host apparatus having lifting arms. The drop hammer assembly has an upstanding frame coupled to the host transport apparatus and a stabilizing foot portion attached to the frame for contacting the ground surface during operation of the drop hammer. A mast is attached to the frame and is disposed substantially vertical to the ground surface for supporting a weight assembly. The weight assembly has a ground confronting face portion and at least one bearing surface engaging the mast, and is operable between a ground position impacting the ground surface and a drop position. A manually controlled lifting apparatus is provided to raise the weight assembly to a predetermined drop position, and is actuable to release said weight assembly for its substantial free fall from the drop position to said ground position. The host transport is delivered to the ground surface to be impacted with the weight assembly being positioned thereover. The height of said predetermined drop position is selected, and the stabilizing foot portion of the drop hammer is lowered onto an area of the ground surface. The weight assembly is raised with the lifting apparatus to the predetermined drop position, which apparatus is then actuated to release the weight assembly for its substantial free fall from the drop position to the ground position.

The invention, accordingly, comprises the apparatus and method possessing the construction, combination of elements, and arrangement of parts and steps which are exemplified in the following detailed description. Reference to that description and to the accompanying drawings should be had for a fuller understanding and appreciation of the nature and objects of the invention, although other objects may be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
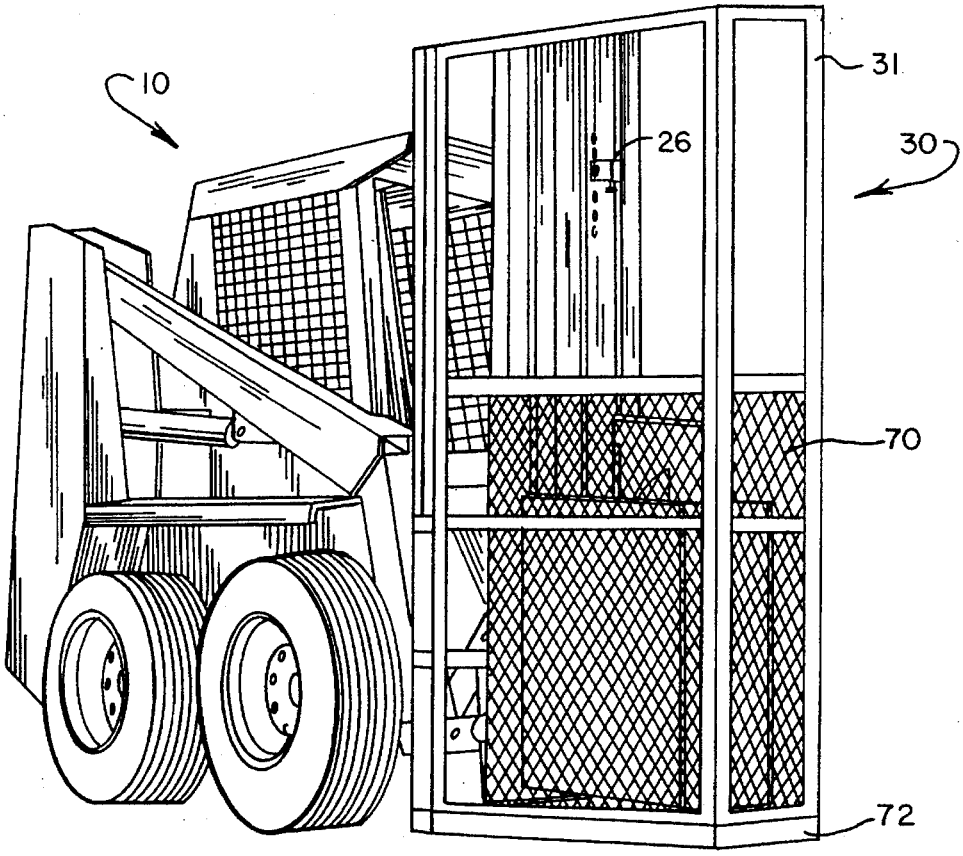
FIG. 1 is a perspective view of a transportable drop hammer in accordance with the present invention shown as having a caged frame mounted to the lifting arms of a host transport apparatus.
Figure 2:
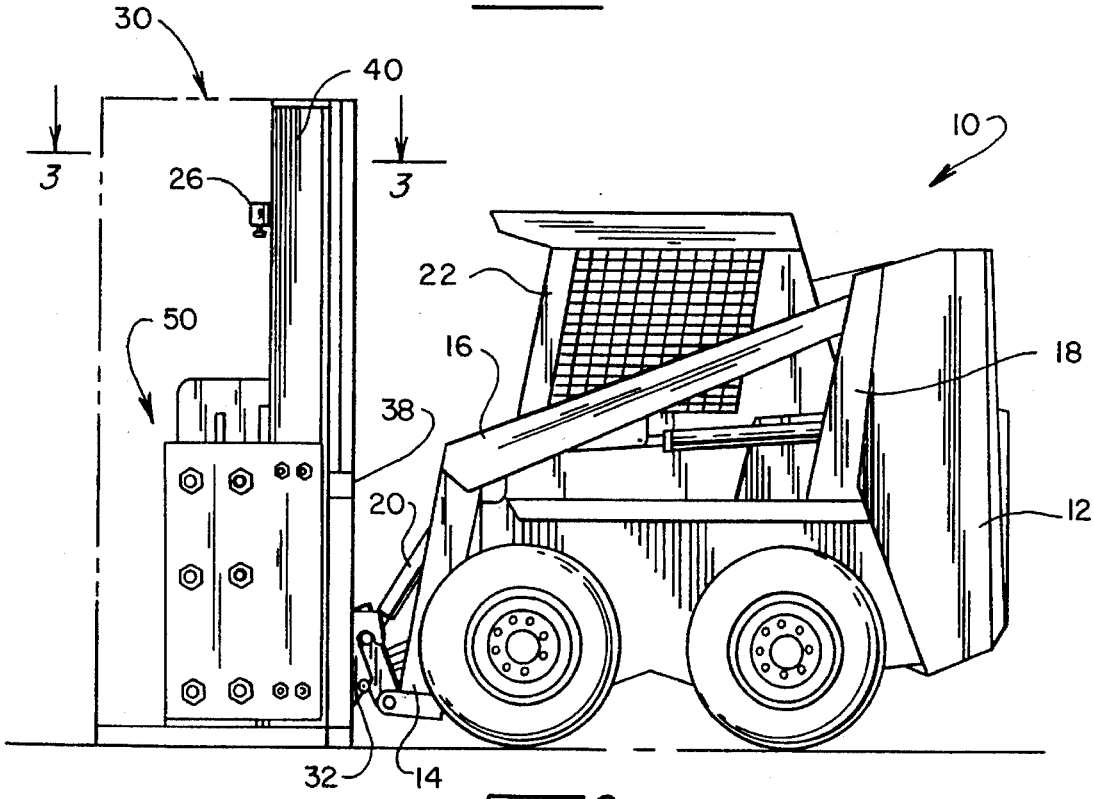
FIG. 2 is a side elevational view of the transportable drop hammer of FIG. 1 wherein the caged frame is shown in phantom.

Referring now to the drawings, wherein like reference numerals designate identical or corresponding components throughout the several views, FIGS. 1 and 2 show the transportable drop hammer assembly 30 in relation to a host transport apparatus 10. The transport apparatus 10 depicted in the figure is shown to be of a skid steer variety having wheels, although the invention is readily adaptable to any number of operator controlled transport vehicles, including those with tracks.

The host transport apparatus 10 is preferably provided with lifting arm members 14, 16 which may be articulated by various hydraulic cylinders, as at 18 and 20, through control by a single operator from within the cab 22 of the host transport apparatus 10. In this regard, an operator can lift and tilt the drop hammer assembly 30 from the ground during transport of the assembly between work areas. The host transport apparatus 10 is also provided with a counterweight 12 to prevent the host apparatus from tipping forward when lifting the drop hammer assembly.

Figure 3:
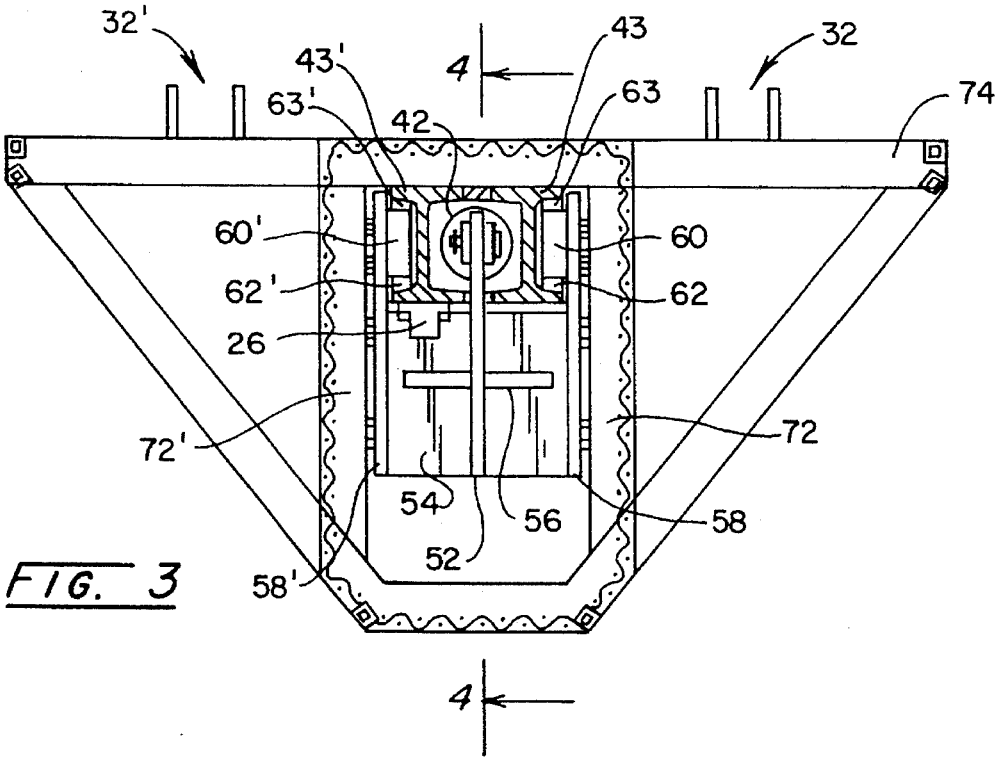
FIG. 3 is a top view showing the caged drop hammer of FIG. 1 in enhanced detail.
Figure 4:
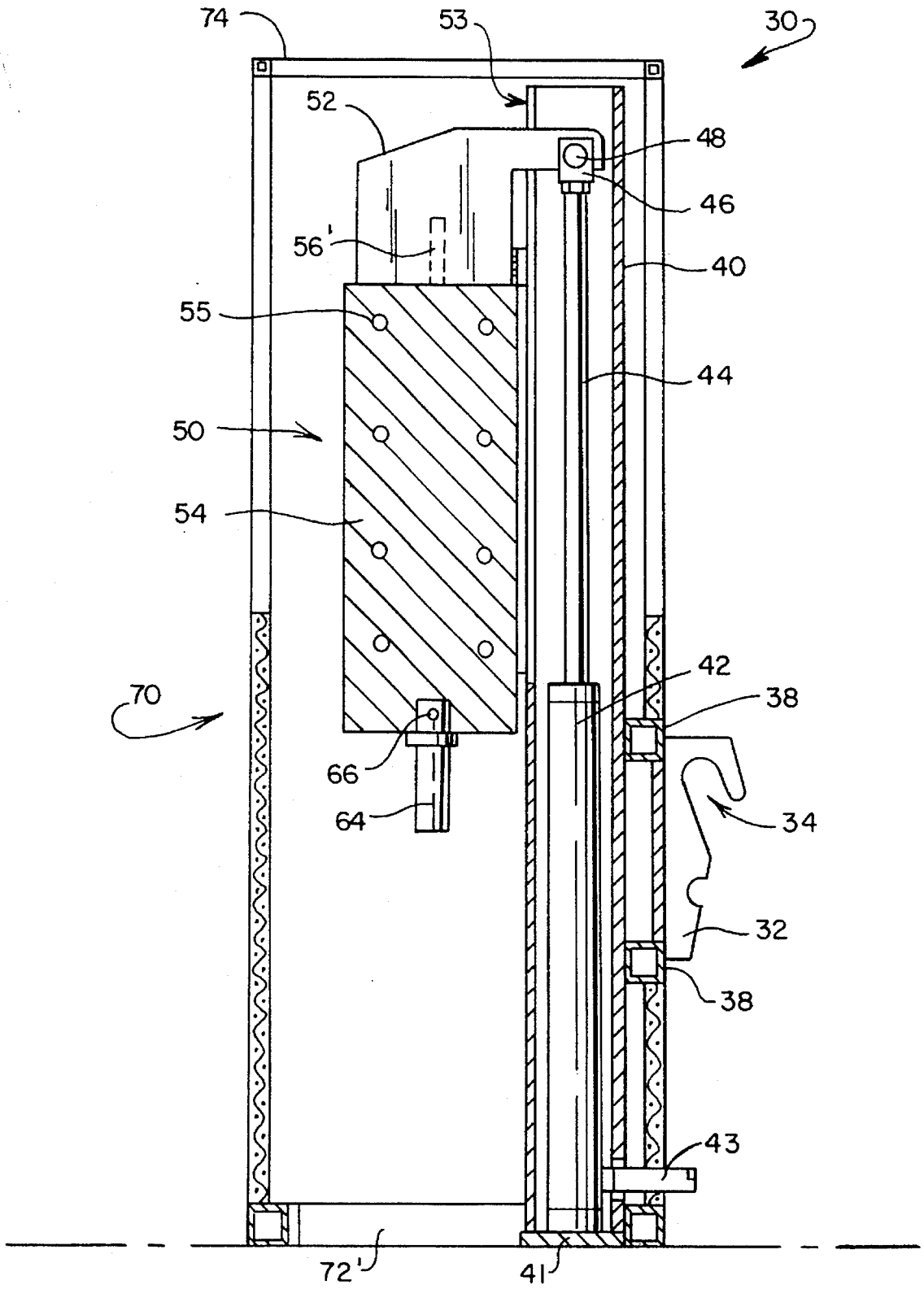
FIG. 4 is a cross sectional view of the drop hammer of FIG. 3 taken through line 4—4 of FIG. 3.

The construction of the drop hammer assembly 30 is depicted in FIGS. 3 and 4. A skeletal frame 31 is formed by attachment of outwardly-extending, horizontal foot portions 72, 72' and rectangular mounting frame 38 to vertical mast 40. The frame 31 is shown to be constructed generally of tubular steel members although other configurations of structural materials may be employed without detracting from the invention. Mounting brackets 32, 32' are attached to frame 38 for securing the drop hammer assembly to the lifting arms 14 of a host apparatus in a conventional manner.

The frame 31 supports a box-like cage assembly 70 generally positioned to cover the moving components of the drop hammer 30. The cage assembly 70 is constructed of a heavy screening material positioned intermediate cage frame 74. The cage 70 is shown to only cover the mast 40 and weight assembly 50, or eliminated altogether, thereby reducing or eliminating the need for associated frame components, such as at 74. In this respect bystanders, as well as the operator of the host transport 10, are partially protected from the moving parts of the drop hammer assembly 30 as well as from flying debris resulting from the breaking up of concrete. As the drop hammer 30 is controlled by the operator from within the cab 22 of the host transport 10, it is desirable to minimize the visual obstructions in the line of sight between the operator and the ground impact area. In this manner, an operator can effectively control the impacting of the drop hammer assembly 30 from within the cab 22 without additional direction from another worker.

The mast 40 is preferably constructed of structural steel members such that a lifting cylinder 42 may be protectably housed. The external flanges of mast 40 may also serve as the vertical guides for the drop weight assembly 50. As depicted in FIG. 3, the mast 40 is composed of dual "I" beams 43 and 43' which have been welded lengthwise to form a generally tubular construct. Replaceable wear plates 62, 62', 63, 63' are mounted along the lengthwise extent of the mast's external flanges. An end cap 41 is welded at the bottom mouth of the combined beams 43 and 43" to add structural support to the mast 40 and to provide a base for lift cylinder 42. A portion of the mast 40, along the seam where the structural members 43 and 43' are joined, is removed to form a lift plate slot 53. This slot permits the lift plate 52 to travel freely between an upper drop position, as shown in FIG. 4, to an impact position, generally shown in FIG. 2. The lift plate slot 53 preferably extends to the top of the mast 40, which enables the weight assembly 50 and the cylinder 42 to be readily removed for maintenance or replacement.

The lift cylinder 42 is preferably hydraulic, although it is envisioned that alternate sources of fluid power, such as pneumatic, may be employed. The lift cylinder 42 is suitably sized such that the stroke extent of the piston rod 44 is sufficient to raise the drop weight assembly 50 to a drop position. The capacity of the lift cylinder 42 as well as its stroke length will vary depending upon the nature of the task to be performed by the drop hammer 30 and may be determined in a convention manner. For example, a drop hammer 30 to be used primarily for tamping loose earth would require lesser drop weight 54 mass than a drop hammer 30 used to break up thick concrete. As seen in FIG. 4, on end of the lift cylinder 42 rests on base plate 41. A means of securing the lift cylinder 42 to the mast 40 (not shown) may be employed but has been determined not to be necessary in this embodiment of the invention due to the containment provided by the mast 40. An oversized supply line 43 is provided to enable fluids to quickly be expelled from the lift cylinder 42 when actuated by the operator. In the preferred embodiment of the invention, the hydraulic supply line 43 is sufficiently sized to permit the drop weight 54 to effectively free fall from the drop position to the impact position.

Lift cylinder 42 is fastened to the drop weight assembly 50 by way of conventional clevis 46 and clevis pin 48 arrangement which engages a portion of the lift plate 52. The lift plate 52, in turn, is welded or otherwise connected to drop weight 54, and may be structurally reinforced by welding brace members 56 and 56' between the lift plate 52 and the drop weight 54. Holes, as at 55, are provided through the lift weight 54 to enable side plates 58 and 58' to be mounted on opposing sides of the drop weight. At the lower, i.e., the ground confronting face of the drop weight 54, a working tool 64 is provided to accomplish a given task, secured by a set screw arrangement 66. While shown to be a bit for breaking up concrete pavement and the like, other tools may be attached in lieu of the bit, for example to tamp ground material or to drive structures into the ground.

Side plates 58 and 58' are fitted with guide blocks 60 and 60', respectively, and are sized to slidably engage wear plates 62, 63 and 62' and 63' as the drop weight 54 is successively raised and dropped. In this manner, the drop hammer assembly 30 is prevented from twisting during the raising and dropping of the drop weight assembly 50.

Figure 5:
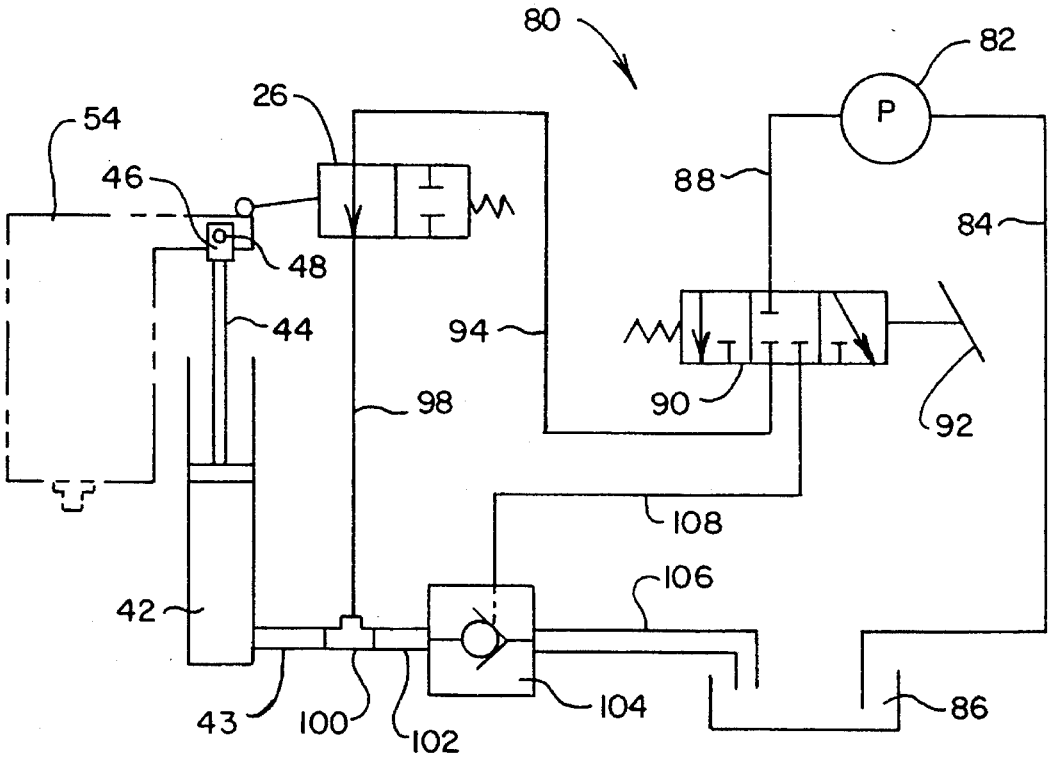
FIG. 5 is a schematic block diagram of a hydraulic circuit for controlling the drop hammer of FIG. 1.

Referring now to FIG. 5, there is depicted a schematic block diagram of the hydraulic control circuit 80 of one embodiment of the present invention. The source of hydraulic power may be either provided by the host transport 10 hydraulic system (not shown) via an auxiliary supply line or by a dedicated power system as graphically depicted in FIG. 5. In the case where the drop hammer assembly 30 is powered by the host transport 10 power system, the pump 82 and the tank 88 would be component parts of the host transport.

In the figure, hydraulic supply line 84 is shown to provide fluid to pump 82 from fluid reservoir 86. When using the available host transport 10 hydraulic system, the need for an auxiliary hydraulic reservoir (not shown), should be evaluated, implementing an additional reservoir if necessary. The output of pump 82 is connected to three-way valve 90 which controls the flow of hydraulic fluid from the pump 82. The valve 90 is preferably of a variety having a spring return to center, so that it is normally open when not engaged. Coupled to valve 90, there can be seen a rocker style pedal switch 92 that, when actuated by an operator causes the three-way valve to supply fluid pressure to the lift cylinder 42 directed through supply line 94 or alternately to bypassable check valve 104 via supply line 108.

Supply line 94 is connected to a limit switch 26 which is mounted on the mast 40 (FIG. 2) in a position corresponding to the upper limit of the travel of the weight assembly 54, which is shown in phantom. The limit switch is preferably of a spring return, lever actuated variety such that it is normally closed, permitting flow of fluid to the lift cylinder 42 until the limit switch 26 is engaged by the upward-traveling drop weight assembly 50. While in its normally closed condition as depicted in FIG. 4, the limit switch 26 permits passage of fluid through supply line 98, oversized coupling 100 and oversized supply line 43 to hydraulic cylinder 42. Consequently, when the three-way valve 90 is actuated to supply fluid pressure via supply line 94, the piston rod 44 of the lift cylinder with extend until the pressure to the cylinder is interrupted by the actuation of limit switch 26.

Alternatively, fluid pressure may be supplied to the pilot port of check valve 104 via line 108, thereby by passing the flow checking function of the check valve. Upon being bypassed, the check valve 104 permits the rapid expulsion of fluid from the body of lift cylinder 42 through oversized hydraulic lines 43, 102 and 106 to the fluid reservoir 86.

Figure 6:
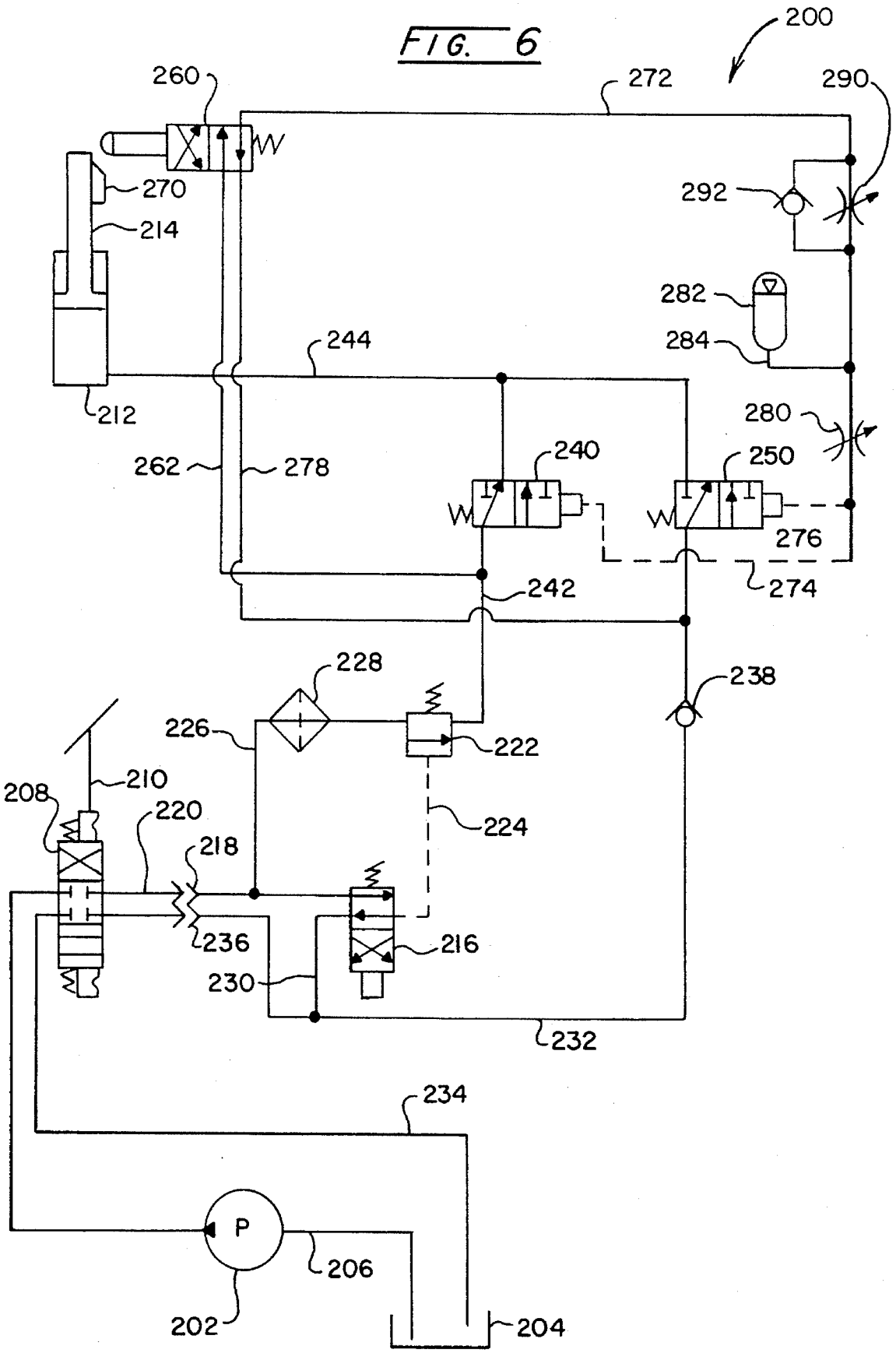
FIG. 6 is a schematic block diagram of an alternative hydraulic circuit for controlling the drop hammer of FIG. 1.

Referring next to FIG. 6, an alternative embodiment of a hydraulic circuit for controlling drop hammer 30 (FIGS. 1, 2, and 4) of the present invention is shown generally at 200, which embodiment continuously reciprocates weight assembly 50 (FIG. 4) of drop hammer 30. As in circuit 80, the source of hydraulic power in circuit 200 may be provided either by the hydraulic system of host transport 10 (FIGS. 1 and 2) via an auxiliary supply line, or by the dedicated power system shown in FIG. 6 to comprise a hydraulic pump 202, coupled in fluid communication with a fluid reservoir 204, via a supply line 206. Where drop hammer assembly 30 is powered by the power system of host transport 10, it will be appreciated that pump 202 and the tank 204 would be integral component parts of the host transport.

The fluid output of pump 202 is coupled via line 206 to a control valve 208. For controlling the flow of fluid from pump 202, valve 208 preferably is provided as being of a three-way variety having a spring return to center such that it is normally closed. A pedal switch 210, which may be of a rocker style type, is operably coupled to valve 208 for controlling the actuation thereof. Pedal switch 210 is actuable by an operator to, in turn, open valve 208 supplying fluid to a lift cylinder 212, having a piston rod 214, which, as was detailed in connection with FIGS. 3, 4, and 5, is operably coupled to weight assembly 50 (FIG. 4). As before, cylinder 212 is fillable with fluid to drive piston rod 214 along a stroke moving weight assembly 50 from its ground position impacting the ground surface to its drop position a predetermined distance above the ground surface.

For safety considerations, a flow control valve 216 is interposed between cylinder 212 and valve 208, and is coupled, preferably with a quick disconnect coupling 218 in fluid communication with valve 208 via line 220. Although it may be lever operated, valve 216 preferably is provided as being of a two-position, two-way type which is cam operated and has a spring offset. As provided, valve 208 is actuable by the contacting of foot portion 72 (FIG. 1) with the ground surface to admit fluid from valve 208 for providing a pilot pressure signal to a sequence valve 222 coupled in fluid communication therewith via a pilot line 224. Sequence valve 222 preferably is of a pilot-to-open variety and is coupled to valve 208 via line 226, which line may be provided with an in-line filter, 228. When piloted by the actuation of valve 216, sequence valve 222 is opened to admit fluid from valve 208 to cylinder 212. In this manner, a measure of safety is achieved in that foot portion 72 must be supported on the ground surface before piston rod 214 of cylinder 214 may be raised. If not actuated by the supporting of foot portion 72 on the ground surface, valve 216 spools to return the fluid flow from valve 208 back therethrough to reservoir 204 via lines 230, 232, and 234. As is shown, line 232 may be coupled to valve 208 with a quick disconnect coupling 236, and is provided as having a check valve 238. Check valve 238 provides an additional measure of safety in preventing reverse fluid flow from by-passing valve 208 to enter cylinder 212.

For controlling the supply of fluid from sequence valve 216 in to and out of cylinder 212, a first 240, second, 250, and third 260, flow control valves are provided, each of which preferably is configured as being of a two-position, two-way type. As is shown, first flow control valve 240 is normally open to receive fluid from sequence valve 222 via line 242, and to admit fluid to cylinder 212 via line 244 to raise piston rod 214. During the filling of cylinder 212, second flow control valve 250, which also is coupled to cylinder 212 via line 244, is maintained in its normally closed position to prevent the return of fluid to reservoir 204, to which it is coupled via lines 232 and 234. Additionally, third flow control valve 260, which is coupled to sequence valve 222 via lines 242 and 262, is positioned in a normally closed orientation maintaining fluid flow from sequence valve 222 through first flow control valve 240 and into cylinder 212.

The described positioning of valves 240, 250, and 260 is maintained until piston rod 214 is raised to an extent such that a camming surface 270 thereof, contacts valve 260. Thereupon, valve 260 is actuated to spool to a position providing a pilot pressure to first valve 240 via lines 272 and 274, and to second valve 250 via lines 272 and 276. The piloting of valve 240 effects its closing to redirect fluid flow from sequence valve 222 through valve 260 via line 262, and back to reservoir 204 via lines 278, 232, and 234. The piloting of valve 250, in turn, effects its opening to admit fluid from the gravity-driven downstroke of cylinder 212 to reservoir 204 via lines 244, 232, and 234. An adjustable flow control valve, 280, is supplied within line 272 to provide a fine adjustment for dampening the pilot signal as it simultaneously actuates valves 240 and 250.

The downstroke of cylinder 212 returns valve 260 to its normally closed position. On this downstroke, pilot pressure is maintained to valves 240 and 250 with an accumulator 282 which is coupled in fluid communication with line 272 via line 284. After accumulator 282 has discharged, the pilot pressure on valves 240 and 250 is relieved through valve 260 via line 272 to return valves 240 and 250 to their respective normal positions directing fluid flow from sequence valve 222 into cylinder 212 to again raise piston rod 214. The rate at which rod 214 is raised is controlled within line 272 with an adjustable flow control valve 290 having an associated check valve 292. Valve 290, which is adjustable to control the fluid flow through lines 274 and 276 relieving the pilot pressure on valves 240 and 250, respectively, thereby provides a variable time delay for controlling the upstroke of cylinder 212. It will be appreciated that as long as valve 208 is actuated, the foregoing cycle is repeated to continuously reciprocate weight assembly 50 (FIG. 4) between its ground and drop positions.

Returning now to FIGS. 2 and 3, drop hammer assembly 30 is shown coupled to host transport apparatus 10 through the engagement of mounting brackets 32 and 32' which are attached to the drop hammer frame 38 by the lift arms 14 of the host apparatus. The mounting brackets are constructed in a hooked configuration which engages a corresponding member of the host transport lifting arms 14 as is well known in the art. Reference may be had to U.S. Pat. No. 5,182,057 issued to Johnson for a transportable bin which may be coupled to a host apparatus 10 via mounting brackets in much the same manner.

During operation, the drop hammer assembly 30 would be mounted to the lifting arms 14 of a host transport apparatus 10 via mounting bracket pair 32 and 32' and then secured in the conventional manner. The fluid supply line 43 is then connected to an auxiliary port of the host transport hydraulic supply or to a dedicated hydraulic power unit, if provided. The limit switch 26, if adjustable, is affixed in a predetermined upper limit position depending upon the amount of impact force needed to accomplish a given task.

After the drop hammer assembly 30 has been secured to the host apparatus 10, the operator lifts the drop hammer assembly off of the ground and drives the host transport to the area at which the drop hammer is to be employed. At that location the operator lowers the drop hammer assembly such that the foot portion of the frame 31 rests firmly upon the ground surface. Once in place, the operator actuates rocker pedal 92 causing the drop weight assembly 50 to raise until such time as the operator releases the pedal or until the upper limit switch 26 is reached.

Once the predetermined upper limit has been reached, the operator actuates the rocker pedal 92 in the opposite direction, thereby directing fluid pressure to check valve 104, thus permitting the rapid expulsion of fluid from the lift cylinder 42 back to fluid reservoir. The operator then repeats this procedure until the desired amount of work has been accomplished, making any necessary adjustments in the upper limit switch 26 as deemed necessary to either increase or decrease the amount of impact force to be applied to the ground surface. As was described in connection with FIG. 6, drop hammer assembly 50 may be provided to continuously reciprocate weight assembly 30 to facilitate the impacting of the ground surface.

The drop hammer assembly 30 is then raised and moved to the next area to be impacted, where the cycle is repeated. As may be readily appreciated from this disclosure a single operator may be employed to accomplish that which previously may have taken more than a single operator. Additionally, having the foot portion of the frame 31 on the ground while raising the drop weight 50 has a significant stabilizing effect on the host apparatus 10. Consequently, an operator can speed up the cycle time without causing the host apparatus to rock appreciably during repeated cycles of the drop hammer.

The foregoing descriptions and drawings merely explain and illustrate the invention and the invention is not limited thereto, except insofar as the claims are so limited, as those skilled in the art who have the disclosure before them will be able to make modifications and variations therein without departing from the scope of the invention.

That which is claimed:

1. A system for impacting a ground surface comprising:

an operator driven host transport apparatus having lifting arms; and a drop hammer assembly removably coupled to said lifting arms of said driven host apparatus, said drop hammer assembly comprising:

an upstanding frame coupled to said host transport apparatus, said frame having a stabilizing foot portion extending outwardly therefrom for contacting the ground surface during operation of said drop hammer;

a mast attached to said frame and disposed substantially vertical to the ground surface;

a weight assembly having a ground confronting face portion and at least one bearing surface engaging said mast, said weight assembly being operable between a ground position impacting the ground surface and a drop position above said ground surface; and a manually controlled lifting apparatus for selectively raising said weight assembly to said drop position, said lifting apparatus being actuable to release said weight assembly for its substantial free fall from said drop position to said ground position.

2. The system of claim 1 wherein said lifting apparatus comprises:

a lift cylinder coupled to said frame having a piston operably coupled to said weight assembly, said lift cylinder being fillable with a fluid to drive said piston along a stroke moving said weight assembly between said ground position and said drop position; and a fluid power system operably coupled to said cylinder for controlling the flow of said fluid to said lift cylinder.

3. The system of claim 2 wherein said fluid power system comprises:

a fluid reservoir for supplying said fluid to said lift cylinder;

a fluid pump coupled in fluid communication with said reservoir and said lift cylinder for providing said fluid under a pressure to fill said lift cylinder;

a first flow control valve coupled in fluid communication with said lift cylinder and said fluid pump, said first flow control valve being actuable to effect the flow of said fluid from said fluid pump into said lift cylinder for raising said weight assembly between said ground position and said drop position;

a bypassable check valve coupled in fluid communication with said lift cylinder and said reservoir for restricting the flow of said fluid from said lift cylinder to maintain said weight assembly at said drop position, said check valve being actuable to admit said fluid from said lift cylinder to said reservoir; and a second flow control valve coupled in fluid communication with said check valve, said second flow control valve being actuable to provide fluid pressure to actuate said check valve admitting said fluid from said lift cylinder to said reservoir at a flow rate effective for said weight assembly to substantially free fall from said drop position to said ground position.

4. The system of claim 3 wherein said first and said second flow control valve assembly are manually actuable by an operator from within said host transport apparatus.

5. The system of claim 3 wherein said first flow control valve is operably coupled to said weight assembly to be actuated by the position thereof for effecting the flow of said fluid into said lift cylinder.

6. The system of claim 5 wherein said first control valve is vertically positionable for determining said drop position.

7. The system of claim 1 wherein said fluid power system is provided to be integral with said host transport apparatus.

8. The system of claim 1 wherein said fluid power system comprises:

a fluid reservoir for supplying said fluid to said lift cylinder;

a fluid pump coupled in fluid communication with said reservoir and said lift cylinder for providing said fluid under a pressure to fill said lift cylinder;

a first flow control valve coupled in fluid communication with said lift cylinder and said fluid pump, said first flow control valve being actuable to effect the flow of said fluid from said fluid pump into said lift cylinder for raising said weight assembly between said ground position and said drop position;

a second flow control valve coupled in fluid communication with said lift cylinder and said reservoir, said second flow control valve being actuable to admit said fluid from said lift cylinder to said reservoir; and a third flow control valve coupled in fluid communication with said first and said second control valve and operably coupled to said weight assembly to be actuated by the position thereof to continuously reciprocate said weight assembly between said ground position and said drop position, said third flow control valve being actuable at said drop position to provide fluid pressure to actuate said second flow control valve admitting said fluid from said lift cylinder to said reservoir at a flow rate effective for said weight assembly to substantially free fall from said drop position to said ground position, and actuable at said ground position to actuate said first flow control valve to effect the flow of said fluid from said fluid pump into said lift cylinder for raising said weight assembly between said ground position and said drop position.

9. The system of claim 8 further comprising a fourth flow control valve coupled in fluid communication with said pump and said first flow control valve, said fourth flow control valve being actuable by the contacting of said foot portion with the ground surface to admit the flow of said fluid from said pump to said first flow control valve.

10. The system of claim 1 further comprising a bit extending from said confronting face of said weight assembly for destructively impacting the ground surface.

11. The system of claim 1 wherein the bearing surface of said weight assembly engaging said mast comprises a replaceable wear plate.

12. A method for impacting a ground surface comprising the steps of:

(a) providing an operator actuated drop hammer assembly removably coupled to an operator driven host apparatus having lifting arms, said drop hammer assembly comprising:

an upstanding frame coupled to the host transport apparatus, said frame having a stabilizing foot portion extending outwardly therefrom for contacting the ground surface during operation of said drop hammer;

a mast attached to said frame and disposed substantially vertical to the ground surface;

a weight assembly having a ground confronting face portion and at least one bearing surface engaging said mast, said weight assembly being operable between a ground position impacting the ground surface and a drop position above said ground surface; and a manually controlled lifting apparatus for selectively raising said weight assembly to said drop position, said lifting apparatus being actuable to release said weight assembly for its substantial free fall from said drop position to said ground position;

(b) delivering said host transport to the ground surface to be impacted;

(c) positioning said weight assembly over the ground surface;

(d) selecting the height of said drop position;

(e) lowering said stabilizing foot portion onto an area of the ground surface;

(f) controlling said lifting apparatus to raise said weight assembly to said predetermined drop position; and (g) actuating said lifting apparatus to release said weight assembly for its substantial free fall from said drop position to said ground position.

13. The method of claim 12 wherein said lifting apparatus is actuable in step (g) to continuously reciprocate said weight assembly between said drop position and said ground position.

14. The method of claim 12 further comprising the steps:

(h) raising said frame foot portion stabilizing foot portion from the ground surface; and (i) advancing said host transport apparatus to the next ground surface to be impacted.

15. The method of claim 12 wherein said lifting apparatus is provided as comprising:

a lift cylinder coupled to said frame having a piston operably coupled to said weight assembly, said lift cylinder being fillable with a fluid to drive said piston along a stroke moving said weight assembly between said ground position and said drop position; and a fluid power system operably coupled to said cylinder for controlling the flow of said fluid to said lift cylinder.

16. The method of claim 15 wherein said fluid power system is provided as comprising a flow control valve operably coupled to said weight assembly to be actuated by the position thereof for effecting the flow of said fluid into said lift cylinder.

17. The method of claim 15 further comprising the steps:

(h) determining whether sufficient force has been transferred from said weight assembly to said ground surface;

(i) adjusting the height of said predetermined drop position; and (j) returning to step (f) of the method.

18. A transportable drop hammer for impacting a ground surface adapted to be removably coupled to a driven host transport apparatus having lifting arms, said drop hammer comprising:

an upstanding frame couplable to the host transport apparatus, said frame having a stabilizing foot portion extending outwardly therefrom for contacting the ground surface during operation of said drop hammer;

a mast attached to said frame and disposed substantially vertical to the ground surface;

a weight assembly having a ground confronting face portion and at least one bearing surface engaging said mast, said weight assembly being operable between a ground position impacting the ground surface and a drop position above said ground surface; and a manually controlled lifting apparatus for selectively raising said weight assembly to said drop position, said lifting apparatus being actuable to release said weight assembly for its substantial free fall from said drop position to said ground position and including a lift cylinder coupled to said frame having a piston operably coupled to said weight assembly, said lift cylinder being fillable with a fluid to drive said piston along a stroke moving said weight assembly between said ground position and said drop position, and a fluid power system operably coupled to said cylinder for controlling the flow of said fluid to said lift cylinder, said fluid power system including:

a fluid reservoir for supplying said fluid to said lift cylinder;

a fluid pump coupled in fluid communication with said reservoir and said lift cylinder for providing said fluid under a pressure to fill said lift cylinder;

a first flow control valve coupled in fluid communication with said lift cylinder and said fluid pump, said first flow control valve being actuable to effect the flow of said fluid from said fluid pump into said lift cylinder for raising said weight assembly between said ground position and said drop position;

a bypassable check valve coupled in fluid communication with said lift cylinder and said reservoir for restricting the flow of said fluid from said lift cylinder to maintain said weight assembly at said drop position, said check valve being actuable to admit said fluid from said lift cylinder to said reservoir; and a second flow control valve coupled in fluid communication with said check valve, said second flow control valve being actuable to provide fluid pressure to actuate said check valve admitting said fluid from said lift cylinder to said reservoir at a flow rate effective for said weight assembly to substantially free fall from said drop position to said ground position.

19. The transportable drop hammer of claim 18 wherein said first flow control valve is operably coupled to said weight assembly to be actuated by the position thereof for effecting the flow of said fluid into said lift cylinder.

20. The transportable drop hammer of claim 19 wherein said first control valve is vertically positionable for determining said drop position.

21. The transportable drop hammer of claim 18 wherein said first and said second flow control valve assembly are manually actuable by an operator from within the host transport apparatus.

22. A transportable drop hammer for impacting a ground surface adapted to be removably coupled to a driven host transport apparatus having lifting arms, said drop hammer comprising:

an upstanding frame couplable to the host transport apparatus, said frame having a stabilizing foot portion extending outwardly therefrom for contacting the ground surface during operation of said drop hammer;

a mast attached to said frame and disposed substantially vertical to the ground surface;

a weight assembly having a ground confronting face portion and at least one beating surface engaging said mast, said weight assembly being operable between a ground position impacting the ground surface and a drop position above said ground surface; and a manually controlled lifting apparatus for selectively raising said weight assembly to said drop position, said lifting apparatus being actuable to release said weight assembly for its substantial free fall from said drop position to said ground position and including a lift cylinder coupled to said frame having a piston operably coupled to said weight assembly, said lift cylinder being fillable with a fluid to drive said piston along a stroke moving said weight assembly between said ground position and said drop position, and a fluid power system operably coupled to said cylinder for controlling the flow of said fluid to said lift cylinder, said fluid power system including:

a fluid reservoir for supplying said fluid to said lift cylinder;

a fluid pump coupled in fluid communication with said reservoir and said lift cylinder for providing said fluid under a pressure to fill said lift cylinder;

a first flow control valve coupled in fluid communication with said lift cylinder and said fluid pump, said first flow control valve being actuable to effect the flow of said fluid from said fluid pump into said lift cylinder for raising said weight assembly between said ground position and said drop position;

a second flow control valve coupled in fluid communication with said lift cylinder and said reservoir, said second flow control valve being actuable to admit said fluid from said lift cylinder to said reservoir; and a third flow control valve coupled in fluid communication with said first and said second control valve and operably coupled to said weight assembly to be actuated by the position thereof to continuously reciprocate said weight assembly between said ground position and said drop position, said third flow control valve being actuable at said drop position to provide fluid pressure to actuate said second flow control valve admitting said fluid from said lift cylinder to said reservoir at a flow rate effective for said weight assembly to substantially free fall from said drop position to said ground position, and actuable at said ground position to actuate said first flow control valve to effect the flow of said fluid from said fluid pump into said lift cylinder for raising said weight assembly between said ground position and said drop position.

23. The transportable drop hammer of claim 22 further comprising a fourth flow control valve coupled in fluid communication with said pump and said first flow control valve, said fourth flow control valve being actuable by the contacting of said foot portion with the ground surface to admit the flow of said fluid from said pump to said first flow control valve.

* * * * *